US006513924B1

(12) United States Patent
Goldberg et al.

(10) Patent No.: US 6,513,924 B1
(45) Date of Patent: Feb. 4, 2003

(54) APPARATUS AND METHOD FOR INK JET PRINTING ON TEXTILES

(75) Inventors: Ira Goldberg, Thousand Oaks, CA (US); Martin Kendig, Thousand Oaks, CA (US); Rachel Lucas, Thousand Oaks, CA (US); Ted McKinney, Riverside, CA (US); Hong-Son Ryang, Camarillo, CA (US); Leonard Alper, Glendale, CA (US)

(73) Assignee: Innovative Technology Licensing, LLC, Thousand Oaks, CA (US)

( * ) Notice: Subject to any disclaimer, the term of this patent is extended or adjusted under 35 U.S.C. 154(b) by 0 days.

(21) Appl. No.: 09/952,614

(22) Filed: Sep. 11, 2001

(51) Int. Cl.[7] ..... B41J 2/01; B41J 3/407
(52) U.S. Cl. ..... 347/106; 347/102
(58) Field of Search ..... 347/100, 102, 347/105–107; 8/445, 495; 428/331

(56) References Cited

U.S. PATENT DOCUMENTS

| | | | | |
|---|---|---|---|---|
| 3,857,676 | A | 12/1974 | Feess et al. | 8/74 |
| 3,900,283 | A | 8/1975 | Hildebrand et al. | 8/21 A |
| 3,950,419 | A | 4/1976 | Baumann et al. | 260/559 R |
| 3,961,878 | A | 6/1976 | Capponi et al. | 8/2 |
| 3,997,928 | A | 12/1976 | Leifeld | 8/149.1 |
| 4,060,387 | A | 11/1977 | Baumann et al. | 8/169 |
| 4,108,595 | A | 8/1978 | Pappas | 8/1 A |
| 4,264,321 | A | 4/1981 | Von Der Eltz | 8/476 |
| 4,268,267 | A | 5/1981 | Duchardt et al. | 8/549 |
| 4,285,218 | A | 8/1981 | Lehmann | 68/5 D |
| 4,647,285 | A | 3/1987 | Scheibli et al. | 8/528 |
| 4,659,333 | A | 4/1987 | Schaub | 8/476 |
| 4,702,742 | A | 10/1987 | Iwata et al. | 8/495 |
| 4,741,739 | A | 5/1988 | Berendt et al. | 8/477 |
| 5,085,668 | A | 2/1992 | Pelster et al. | 8/549 |
| 5,251,547 | A | 10/1993 | Frigeni | 101/232 |
| 5,273,551 | A | 12/1993 | Brehme et al. | 8/500 |

(List continued on next page.)

OTHER PUBLICATIONS

Developments in Jet Inks for Textile Printing, Ray A. Work, III et al.Techexchange.com. p. 1–4.
Ink Jet Systems for Printing Fabric, Textile Chemist and Colorist & American Dyestuff Reporter, vol. 32, No. 10, p. 24–27, Oct. 2000.
A Simple, Universal Approach to Ink Jet Printing Textile Fabrics, Ervine, et al., Texile Chemist and Colorist & American Dyestuff Reporter, vol. 32, No. 10, p. 26–27, Oct. 2000.

*Primary Examiner*—John Barlow
*Assistant Examiner*—An H. Do
(74) *Attorney, Agent, or Firm*—Koppel, Jacobs, Patrick & Heybl

(57) ABSTRACT

An apparatus and method for ink jet printing on textiles is disclosed, wherein the steps of pre-treating, ink jet printing, and post-treating the textile takes place at the ink jet printer. A preferred method includes the steps of applying a pre-treat to the textile, evaporating excess water from the pre-treat, ink jet printing a pattern on the pre-treated textile, evaporating water from the ink in the pattern, applying a binder/post-treat to the pattern and curing the binder. The textile printing apparatus prints on an untreated textile by having a first application device to apply a pre-treat aqueous solution to the textile. A first heating element is arranged to evaporate most or all of the water from the pre-treated textile as it passes. An ink jet printer then accepts the pre-treated textile and prints the desired pattern on it. A second heating element at the output of the printer evaporates water from the ink in the pattern as the printed textile passes. A second application device applies a binder/post-treat to the printed textile after the ink evaporation. A third heating element dries and cures the binder/post-treat.

37 Claims, 5 Drawing Sheets

U.S. PATENT DOCUMENTS 5,389,108 A 2/1995 Fritzsche et al. ..... 8/444
5,397,848 A 3/1995 Yang et al. ..... 525/477
5,510,415 A 4/1996 Zahrobsky et al. ..... 524/506
5,542,972 A 8/1996 Von Der Eltz et al. ... 106/22 H
5,607,482 A 3/1997 Reiff et al. ..... 8/495
5,679,115 A 10/1997 Fritzsche et al. ..... 8/444
5,698,478 A 12/1997 Yamamoto et al. ..... 442/153
5,709,955 A 1/1998 Nohr et al. ..... 428/507
5,747,550 A 5/1998 Nohr et al. ..... 522/34
5,811,199 A 9/1998 MacDonald et al. ..... 428/515
5,853,861 A 12/1998 Held ..... 428/207
5,936,027 A 8/1999 Zahrobsky et al. ..... 524/506
6,001,137 A * 12/1999 Alfekri et al. ..... 8/445

* cited by examiner

APPARATUS AND METHOD FOR INK JET PRINTING ON TEXTILES

BACKGROUND OF THE INVENTION

1. Field of the Invention

This invention relates to printing on textiles, and more particularly to a printing apparatus and method for ink jet printing on textiles.

2. Description of the Related Art

Some of the current methods for printing on textiles include roller printing, screen-printing and transfer printing. These methods require the preparation of print or screen plates, which can take 2 to 3 weeks and can be very expensive. There are additional factors of time, labor and material contributing to initial cost, such as set-up of screens or rolls to determine pattern registration and "strike offs" to evaluate the color accuracy. As a result, these methods are not cost efficient for printing one of a kind or small quantities of textiles. They are more commonly used for printing large quantities of a textile where the cost of preparing the plates can be spread over the entire quantity. However, one of the problems with printing large quantities of a textile is that the period for a particular fashion is often short. A change in fashion can lead to large, wasted stockpiles of out-of-fashion printed textiles. Also, there is a need to produce one-of-a-kind textiles such as haute couture fashion. Using the current methods, the cost of printing these small quantities is extremely high.

These problems have created interest in low cost methods and devices for printing on textiles that would be practical for printing small quantities. There is also interest in a method or device that does not have the 2–3 week time delay associated with preparation of the plates. The additional factors described above could extend the delay for months. This necessitates the fashion driven investor to take risks in pattern and color development to get the product to market on time.

Textile printing by ink jet printers has been proposed for printing small quantities. However, ink jet printers use low viscosity ink and the high viscosity ink that is conventionally used to print on textiles cannot be used in conventional ink jet printers because it does not properly flow through the ink jet nozzles. Also, low viscosity inks deposited on textiles are prone to spreading because textiles generally do not effectively retain ink. This problem is compounded by the fact that ink jets deposit only a small amount of ink on the textile for a particular pattern so the pattern easily abrades, washes away or fades. Considerable difficulties have been encountered in providing ink jet printed textiles with patterns that are durable, vibrant and do not fade from washing or exposure to the sun.

Various textile coatings and treatments have been applied to textiles to address these problems. For example, compounds such as starch, cellulose, gum arabic, and polyvinyl acetate have been placed on textiles before ink jet printing to reduce spreading or fading of the ink. Although an improvement, the ink jet patterns are still not as sharp as patterns produced by conventional methods and washing or exposure to the sun can result in significant color fading. Also, these treatments are usually applied at a location remote from the printer, where the textile is also dried and re-rolled. This can add time and expense to the printing process.

Applying a protective polymer coating after printing has also been used as a temporary solution. However, this requires a separate off-line process and has not been particularly effective. Often it causes the ink to bleed along the textile fibers and reduces print resolution. Also, the additional processing adds significant cost and minimizes the advantage of the rapid turn around that ink jet printing could provide.

Heat set or radiation cured inks have been used with ink-jet printers but this adds another step in the process, which adds cost and time and reduces the advantage of ink-jet printing for fast turn-around. Furthermore, these inks cause the textile to have a poor feel or texture because they form a stiff surface on curing.

Other treatments have been developed to improve the waterfastness of ink jet printed textiles. U.S. Pat. No. 4,702,742 to Kazuo discloses a method for ink jet printing textiles wherein an acceptor for the ink is deposited on the textile prior to printing, with the preferred acceptor being a water-soluble natural or synthetic polymer. Aqueous ink is then deposited on the textile by ink jet printing. The method includes the optional step of fixing the dye in the ink.

U.S. Pat. No. 6,001,137 to Alfekri et al. also discloses a method for ink jet printing of textiles wherein the textile is treated with a polymer or copolymer of epihalohydrin prior to ink jet printing. A softener such as tetraalkylammonium salt may also be deposited on the textile to give it a soft feel, and a cationic binder may also be deposited on the textile.

U.S. Pat. No. 5,853,861 to Held, discloses an ink/textile combination for ink jet printing patterns on a textile with improved durability and waterfastness. The ink contains an aqueous carrier, a pigment and a polymer having acid, base, epoxy or hydroxy functional moieties. The textile contains hydroxyl, amine, amido or carboxyl groups and a crosslinking agent, wherein upon exposure of the printed image to an external energy source, the crosslinking agent reacts with the textile and the polymer in the ink.

U.S. Pat. No. 5,698,478 to Yamamoto et al., discloses an ink jet printing cloth and printing process that improves the depth and brightness of the patterns printed on the cloth while not staining the cloth with a pre treating cationic substance. The ink jet cloth is composed mainly of cellulose fiber that contains 0.1 to 50% by weight of cationic substance, 0.01 to 5% by weight of an alkaline substance and 0.01 to 20% by weight of an ammonium salt of a polyvalent acid.

The primary disadvantage of these methods and products is that they require additional steps of preparing the textile before ink jet printing. This can require applying the substance to the textile and drying the textile (if necessary) at a remote location, adding time and expense. Post-treatments are also commonly applied and dried at a remote location, which can also add time and expense.

SUMMARY OF THE INVENTION

The present invention provides a new printing apparatus and method for ink jet printing on textiles wherein the steps of pre-treating, ink jet printing, and post-treating the textile takes place at the ink jet printer. This provides ink jet printing of textiles in one step and at one location, eliminating the time and expense incurred in the remote application of post- or pre-treat substances and the related drying and re-rolling. The invention also results in patterns that are more durable and fade resistant than conventional ink jet printed textiles. The pattern can also have better print resolution and brighter colors.

The new method includes the steps of applying a pre-treat to the textile, evaporating excess water from the pre-treat, ink jet printing a pattern on the pre-treated textile, evaporating water from the ink in the pattern, applying a binder/post-treat to the pattern and curing the binder. Alternatively, the pre-treatment and pre-treatment water evaporation steps can be omitted by ink jet printing on a textile that has already been pre-treated. The textile still goes through the steps of having the water from the ink evaporated, and the binder/post-treat applied and cured.

The new printing apparatus is arranged so that a scoured and/or bleached textile known as "prepared for printing" (PFP) textile can be fed into it with the new apparatus having a first depositing assembly to apply a pre-treat aqueous solution to the textile. A first evaporation assembly is arranged to evaporate most or all of the water from the pre-treated textile as it passes. An ink jet printer then accepts the pre-treated textile and prints the desired pattern on it. A second evaporation assembly is positioned at the output of the printer to evaporate water from the ink in the pattern. A second application device then applies a binder/post-treat solution to the printed textile and a third evaporation assembly dries and cures the binder/post-treat. In a preferred embodiment the evaporation assemblies dry the solutions and ink, and cure the binder/post-treat by applying heat to the textile.

The new apparatus can have feeders and rollers at its input and output so that the PFP textile can be automatically fed into the new printer and rolled immediately after printing and curing. The pattern to be printed on the textile is electronically loaded into the printer, preferably from a computer over a standard data bus. The pattern can be loaded into the computer from a variety of peripheral devices such as digital cameras or scanners, or over a data network such as the Internet.

The new apparatus and method can be used to print large and small quantities of textiles quickly and inexpensively. They are particularly applicable to printing relatively small quantities or series of textiles where small changes are required between each step such as printing different names and logos. It can also be used to match and print antique, damaged or faded textiles, to print sampling patterns on textiles for the fashion industry, or to print images on T-shirts and other novelty items. Conventional printing systems are limited to the size or repeat and the number of colors in the patterns. The invention provides a significant improvement over conventional methods. New and original designs can be produced from the computer onto finished fabrics in minutes, and color changes and repeat size alterations can be created in an equally brief time period.

These and other further features and advantages of the invention will be apparent to those skilled in the art from the following detailed description, taken together with the accompanying drawings, in which:

DETAILED DESCRIPTION OF THE INVENTION

New Textile Printing Method

Figure 1:
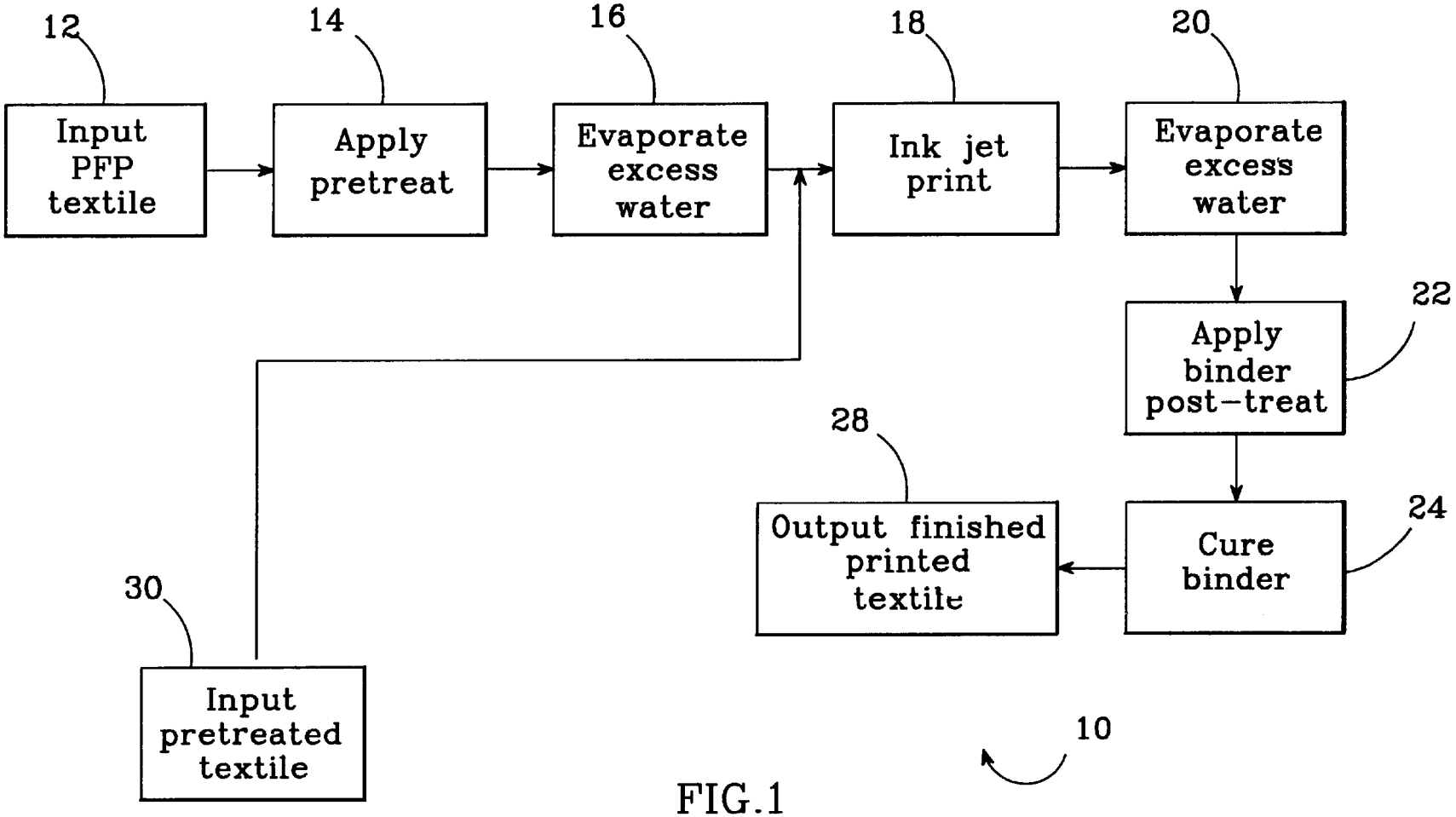
FIG. 1 is a flow diagram for the new method of ink jet printing on a textile.

FIG. 1 is a flow diagram 10 of a textile ink jet printing method in accordance with the present invention. Textiles include but are not limited to cloths made of fibers such as natural fibers of cotton, wool, silk, hemp, linen, ramie, etc.; regenerated fibers of cupra or rayon; synthetic fibers of acryl, nylon, or acetates or mix-spun cloth of these fibers with other fibers, such as fibers of polyester, vinylin, polypropylene, acetate, triacetate, etc., dyeable with a soluble dye or pigment colorant.

The new method includes the initial step 12 of inputting a textile/cloth that does not have a pre-treat, binder, post-treat or any other added substance to improve the textile's ability to protect or retain an ink jet printed pattern. This type of cloth is known in the art as a PFP textile.

In the next step 14, a pre-treat is applied to the PFP textile, which serves as an ink catalyst or adhesion promoter. The pre-treat solution should include substances that bind to the hydroxyl and carboxyl groups in the cellulose fabrics, or to the amine or amino groups in protein fabrics, or to the reactive groups in synthetic fabrics. It should also bind to pigment in ink so that it forms an interfacial layer that attaches the ink to the textile. Many different commercially available pre-treat solutions can be used and many different methods can be used to apply the pre-treat including, but not limited to, spraying, padding, rolling or submerging the textile in the pre-treat solution.

In the next step 16, excess water is evaporated from the pre-treat on the textile. The evaporation can be accomplished by many different methods including but not limited to the following: direct heating with gas flame or catalytic combustion, electrical elements or heating plates, blowing heated or unheated air over the textile, microwave radiation, or IR radiation. Any method can be used that applies heat to the textile without scorching it.

In the next step 18, the desired pattern is printed on the textile using an ink jet printer and in the preferred embodiment the printer uses pigmentized ink or dye ink. Many different commercially available ink jet printers can be used including but not limited to the Hewlett-Packard HP 5000 PS, Encad Novajet 850 and Encad Chroma 24.

Ink deposited by an ink jet printer is aqueous and generally has only 2–8% solids, which keeps the viscosity f the ink low enough that it can pass through the ink jets. In the next step 20, the excess water in the ink jet printed pattern is evaporated using the one of the same types of heating methods used in pre-treat evaporation step 16.

In step 22 a binder/post-treat solution is applied to the textile to protect the printed pattern from abrasion and fading. The binder also preferably has ultra violet (UV) inhibitors to protect the pattern from fading when exposed to sunlight, and can have substances to keep the colors in the pattern bright. The preferred binder/post-treat forms a protective coat over the ink and binds to the previously applied pre-treat.

In step 24, the binder/post-treat is cured on the pattern using one of the same methods used in steps 16 and 20 to dry the pre-treat and ink. The binder/post-treat can also be cured using steam or ultra violet (UV) radiation. Once the post-treat is cured, in step 28 the finished printed textile is output.

In an alternative method, steps 12, 14 and 16 can be bypassed by using a textile that already has a pre-treat applied and has been dried prior to the printing process. This method begins with the step 30 of inputting the pre-treated textile, with the next step being ink jet printing step 18. The same steps 20, 22, 24, and 28 described above are then followed. Still in another embodiment, the pre-treat can be added to the ink jet ink so that it is applied to the PFP textile along with the ink and dried at the same time that the ink is dried. In this embodiment, steps 14 and 16 can be skipped.

In another alternative method, the post-treat can be mixed with the ink jet ink so that the post-treat is applied with the ink. The ink can be dried at the same time that the post-treat is dried and cured. Step 22 can be eliminated and steps 20 and 24 can be combined into one step. Otherwise all the same steps are followed in this method.

Figure 2:
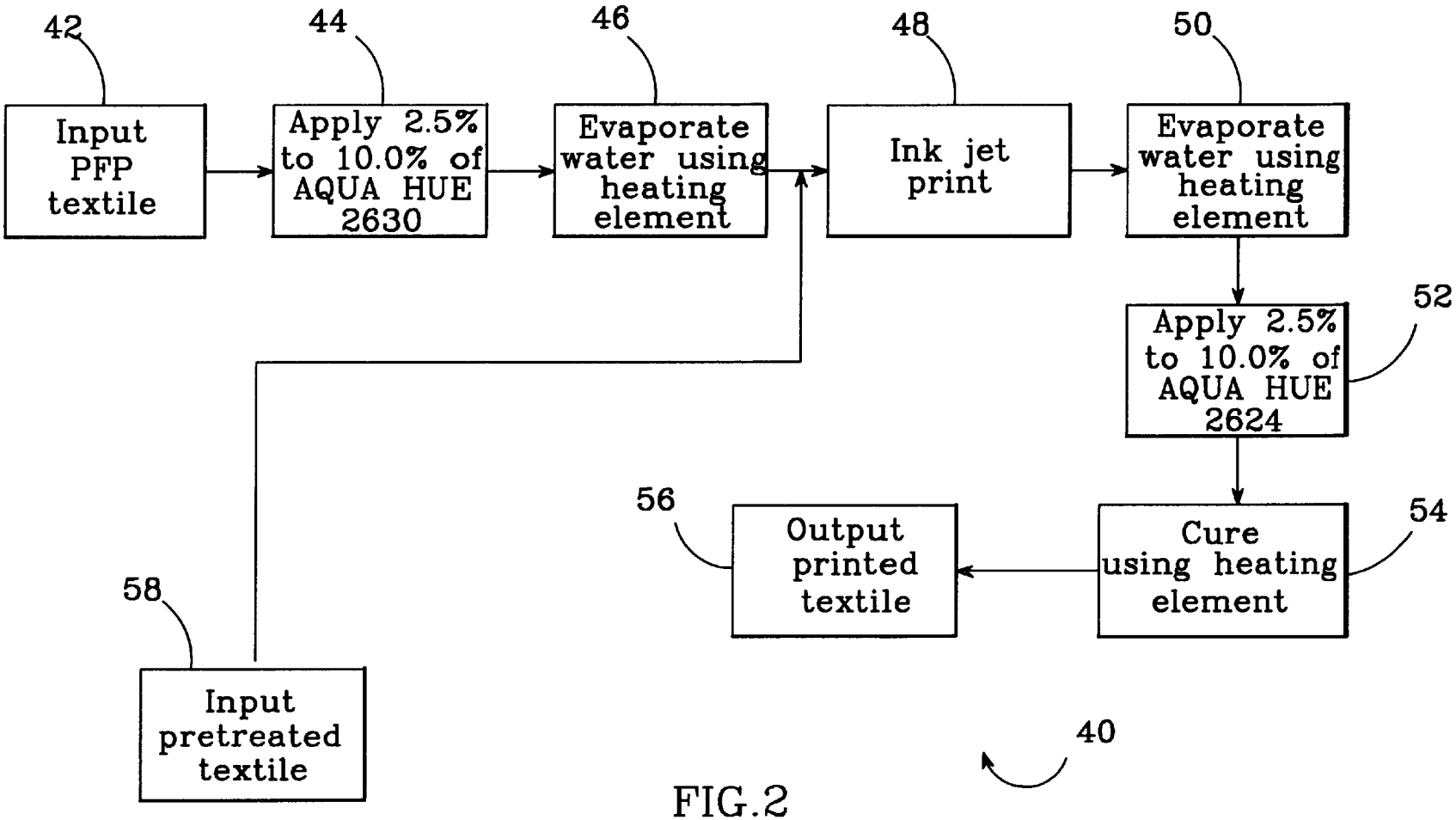
FIG. 2 is a flow diagram of a preferred embodiment of the new method shown in FIG. 1.

FIG. 2 shows a flow diagram 40 of a preferred textile printing method in accordance with the present invention. Like above, the first step 42 is the input of a PFP textile. In the pre-treat application step 44, a solution of commercially available pre-treat such as Aqua Hue Pre Treat 2635 for cellulose materials, produced by Blackman Uhler Chemical Company, is applied to the textile with the preferred application method being spraying. Aqua Hue 2635 is a cationic (positively charged) suspension of acrylic polymers that contains amine or other hydrogen acceptor groups that accept a proton and provide the cationic characteristics that enhance its ability to bind to the hydroxyl and carboxyl groups on the cellulose of cotton, linen and rayon. The pre-treat is commercially available in a concentrated form and is mixed with water to concentration up to 10%, with the preferred concentration being in the range of 2.5 to 5%. If the pre-treat is applied with too large a concentration the textile can become stiff when the pre treat is dried.

Figure 4:
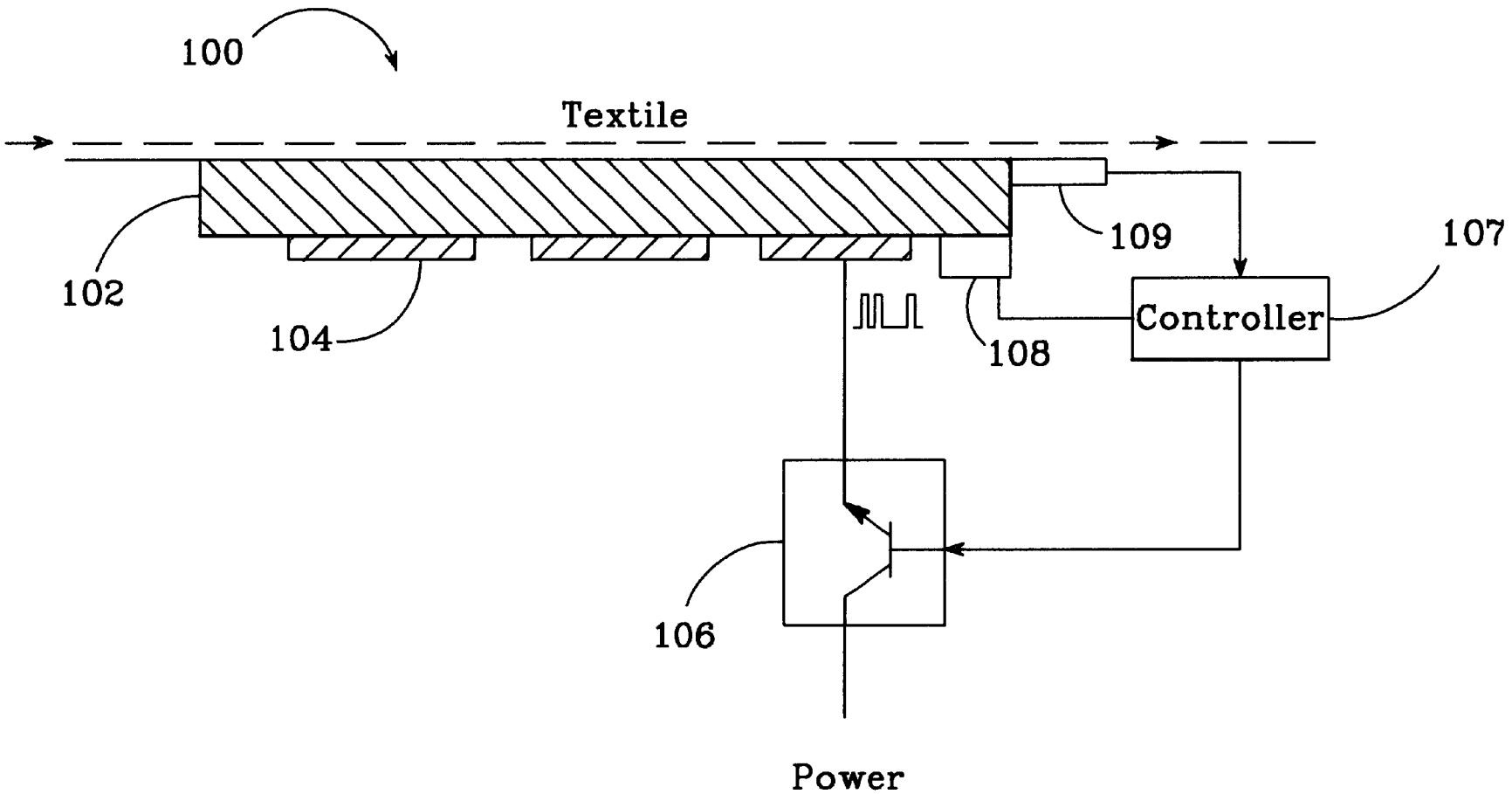
FIG. 4 is a diagram showing the essential components and interconnections of one of the three heater elements in the new printing apparatus.

In the next step 46, the excess water in the pre treat is evaporated by a heating element, preferably by passing the textile over a temperature controlled heating plate. The preferred heating plate is shown in FIG. 4 and described in further detail below. It should be hot enough to evaporate the water from the pre-treat solution without scorching the textile. It is estimated the heating plate should produce 1500 Watts per foot-per minute of fabric speed to dry a wet cloth about 60 inches wide. However, the drying time for different textiles can be different at a given temperature. For instance at 357°±7° F., cotton scorches in approximately 40 seconds and linen scorches in less than approximately 40 seconds. At 325°±1° F., cotton scorches in approximately 90 seconds and linen scorches in approximately 120 seconds. The temperature of the heat plate should be adjusted depending on the type of textile and the speed the textile passes over the heat plate. In the evaporation step 46 the heating plate is approximately 240° F.

In the next step 48, a pattern is ink jet printed on the pre-treated textile, preferably using a high quality ink jet printer such as a Hewlett-Packard HP 5000PS or Encad Novajet 850 ink jet printer, which both have suitable color control. In the ink-drying step 50, the textile is again passed over a heating element similar to the one in step 46, to evaporate the ink's excess water. A typical temperature range for the heat plate in drying step 50 is 180–220° F.

In the binder/post-treat application step 52, a solution of a binder or post-treat that is compatible with the ink, pre-treat, and the type of textile, is applied to the textile. Instead of being a solution, the binder/post-treat can be a pure material or a suspension of material in water. The preferred binder/post-treat is commercially available, but other binders/post-treats can also be used. One suitable binder/post-treat is the Aqua Hue Binder 2674 for cellulose fabrics, produced by Blackman Uhler Chemical, and the preferred application method is spraying. Aqua Hue 2674 is a polyacrylonitrile latex that forms a protective coat over the printed pattern and binds to the previously applied pre-treat. The binder is available in a concentrated form and is mixed with water to a concentration in the range of 2.5 to 10%. In step 54 the post treat is cured by a heating element that is preferably a heating plate. The textile passes over the heating plate, where the binder is cured at a temperature in the range of approximately 320 to 350° F. The final step 54 is the output of a finished printed textile.

Like the method in FIG. 1, steps 42, 44, and 46 can be bypassed by inputting a pre treated textile 56. Steps 44 and 46 can be bypassed by mixing the pre-treat with the ink jet's ink. Also, by mixing the post-treat with the ink, step 52 can be bypassed, and steps 50 and 54 can be combined.

New Textile Printer

Figure 3:
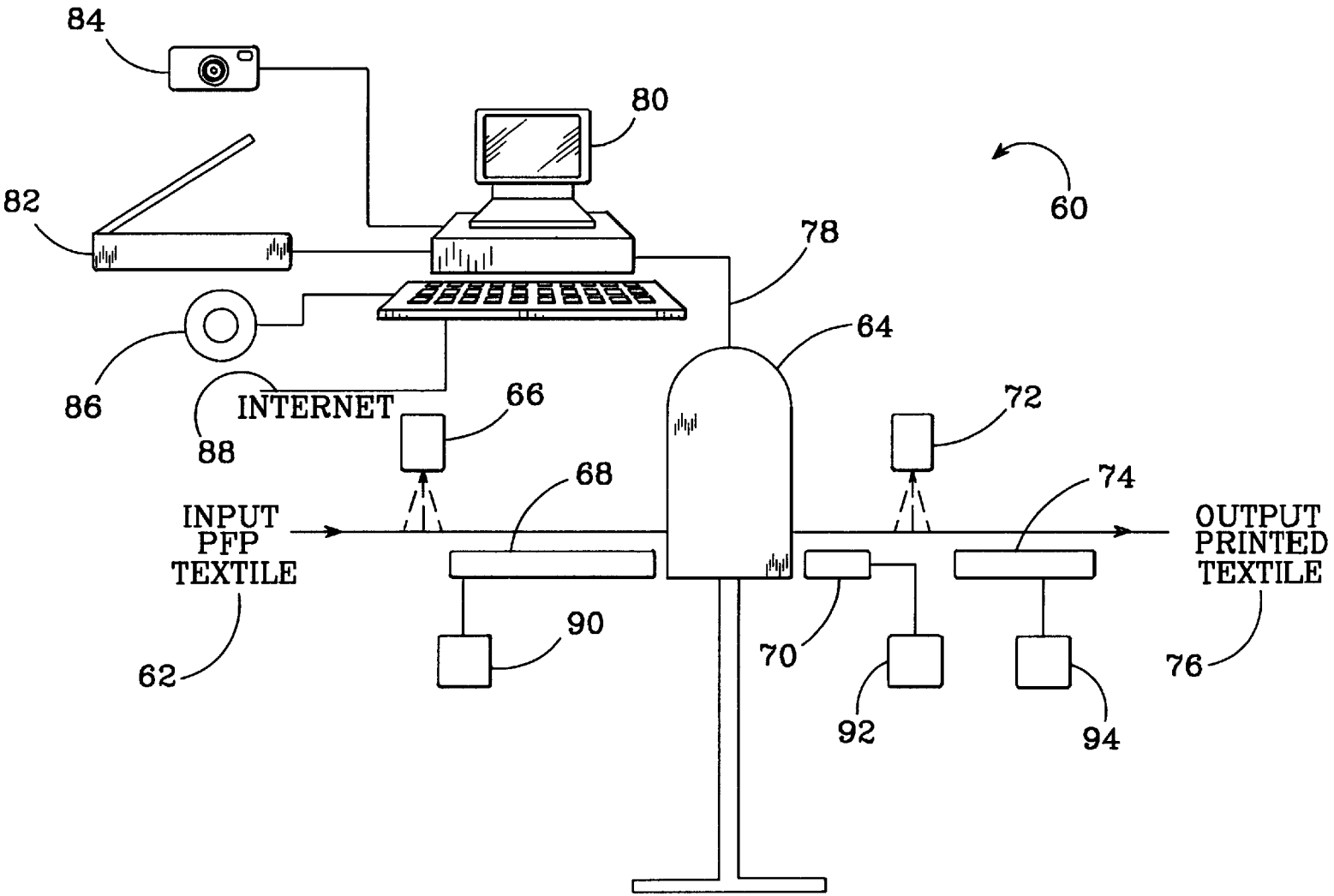
FIG. 3 is a diagram showing the essential components and interconnections of the new textile printing apparatus.

FIG. 3 shows a diagram of the new textile printing apparatus 60 that can ink jet print durable and vibrant patterns on PFP textiles quickly, easily and inexpensively, with the entire process taking place at the ink jet printer. It includes a supply of PFP textile 62 to be printed. The textile can have a paper backing to allow it to more efficiently be fed into the printer 60, although the new printer can also work without the paper backing. If the PFP textile is to be printed in large quantities it can be held on roll, although the textile can be supplied in other forms such as single sheets or folded quantities. The textile is fed through the new apparatus at the speed of the ink jet printer 64 with the ink jet printer pulling the PFP textile from its supply 62.

As the textile is pulled into the ink jet printer 64, it first passes under a first spray device 66 that is arranged to deposit a layer of pre-treat solution on the untreated textile as it passes. The printing apparatus 60 also has a first heating device 68 that the now pre-treated textile passes over to evaporate water from the pre-treat solution. The preferred heating device 68 is a metallic heating plate that the textile contacts as it passes so that heat from the plate heats the textile.

The textile is then pulled into the ink jet printer 64 where the desired pattern is printed on it. The newly printed textile then passes over a second heating device 70 arranged to evaporate water from the ink in the pattern. Like above, the preferred second heating device 70 is a metallic heating plate that the textile contacts as it passes.

A second spraying device 72 is arranged to deposit a layer of binder/post treat on the textile after the ink in the pattern is dried. The now post-treated textile passes over a third heating device 74 that heats the textile to dry and cure the binder/post-treat over the pattern, with the preferred third heating device 74 being a heating plate. After the binder/post-treat is dried/cured, the printed textile 76 is ready for use or it can be stored. One way to store the printed textile is to re-roll it.

The pattern to be deposited on the textile must be loaded into the ink jet printer 64 from a electronic device before it is printed on the textile, and it is preferably loaded from a personal computer (PC) over a standard communication bus 78. The pattern can be generated on graphics software within the PC 80, or loaded into the PC from a peripheral device such a scanner 82, digital camera 84 or magnetic disk or compact disk 86, or over a data bus such as the Internet 88. The image can then be stored in memory on the PC 80 or communicated directly to the ink jet printer 64.

Each of the heating devices 68, 70 and 74 has a respective temperature controller 90, 92 and 94. Depending on the type of textile being printed, and the amount of pre-treat, ink and binder deposited on the textile, the temperature of the plates in the preferred heating devices 68, 70 and 74 can be adjusted to evaporate water in the pre treat or ink, or to cure the binder without scorching the textile. Also, the speed at which the pattern is printed on the textile in the new printer 60 is limited by the speed of the ink jet printer 64 and the ink jet printer 64 can print at different speeds depending on the complexity of the pattern. As the speed of ink jet printer 64 changes, the temperature at the heating plates 68, 70 and 74 can be adjusted so that the heating of the textile is coordinated with the speed of the printing.

FIG. 4 shows a diagram of the preferred heating device 100 that includes a heating plate 102 that can be made of any thermally conductive material, but is preferably made of copper and/or aluminum, both of which have high thermal conductivity. The plate 102 is preferably rectangular shaped, with its longitudinal side being slightly longer than the width of the textile. The textile 101 passes over and in contact with the top surface of the metallic plate 102 so that heat passes into the textile. A number of heating bars 104 are affixed to the bottom surface of the plate 102 so that when they are heated, the heat is conducted into the plate 102. The bars are wide enough and spaced so that heat is spread throughout the plate 102. In the preferred heating device 100 used to heat a textile 60 inches wide, the plate 102 is approximately 64 inches long. The plate 102 has at least three equally spaced bars 104 that are approximately 60 inches long and arranged along the length of the plate 102, parallel to its longitudinal axis. Two smaller heating bars may be placed at either end of the plate to provide additional temperature control. The bars 104 are connected to the output of a solid state switch 106, whose input is connected to a power source that is preferably a standard "wall" power (120 volt alternating current power source). The switch 106 is opened or closed by a controller 107, and when the switch 106 is closed, the power is transferred to the heating bars, causing them to heat.

A temperature-measuring device 108 is placed in a location on the metal plate 102 that represents a desired peak or average temperature for the heating element 100. In the preferred embodiment, the temperature-measuring device 108 is a thermocouple. The desired temperature of the plate 102 is set at the controller 107 and the current temperature of the plate 102 is coupled to the controller 107. The output of the thermocouple is fed into the controller 107 that then activates the switch 106 depending on the thermocouple input. If the temperature of the plate 102 needs to be increased, the switch 106 is opened and closed more frequently by the controller, sending more pulses of power to the heating bars 104. If the temperature of the plate needs to be reduced, less frequent pulses of power are sent to the heater bars 104 or the pulses are discontinued.

In an alternative embodiment, a moisture sensor 109 can be included at the trailing edge of each heating plate 102 to measure the level of moisture in the textile after passing over the heating element. The output of the moisture sensor can be coupled to the controller 107, which uses the output to increase or decrease the number of pulses sent to the heater bars 104. For example, if the moisture sensor 109 senses that there are unacceptable levels of moisture in the textile after passing over the heating plate 102, the number of pulses to the plate can be increased. If the sensor 109 senses that the moisture level that is too low, there is a danger that the textile can be scorched and the number of pulses can be decreased.

Figure 5:
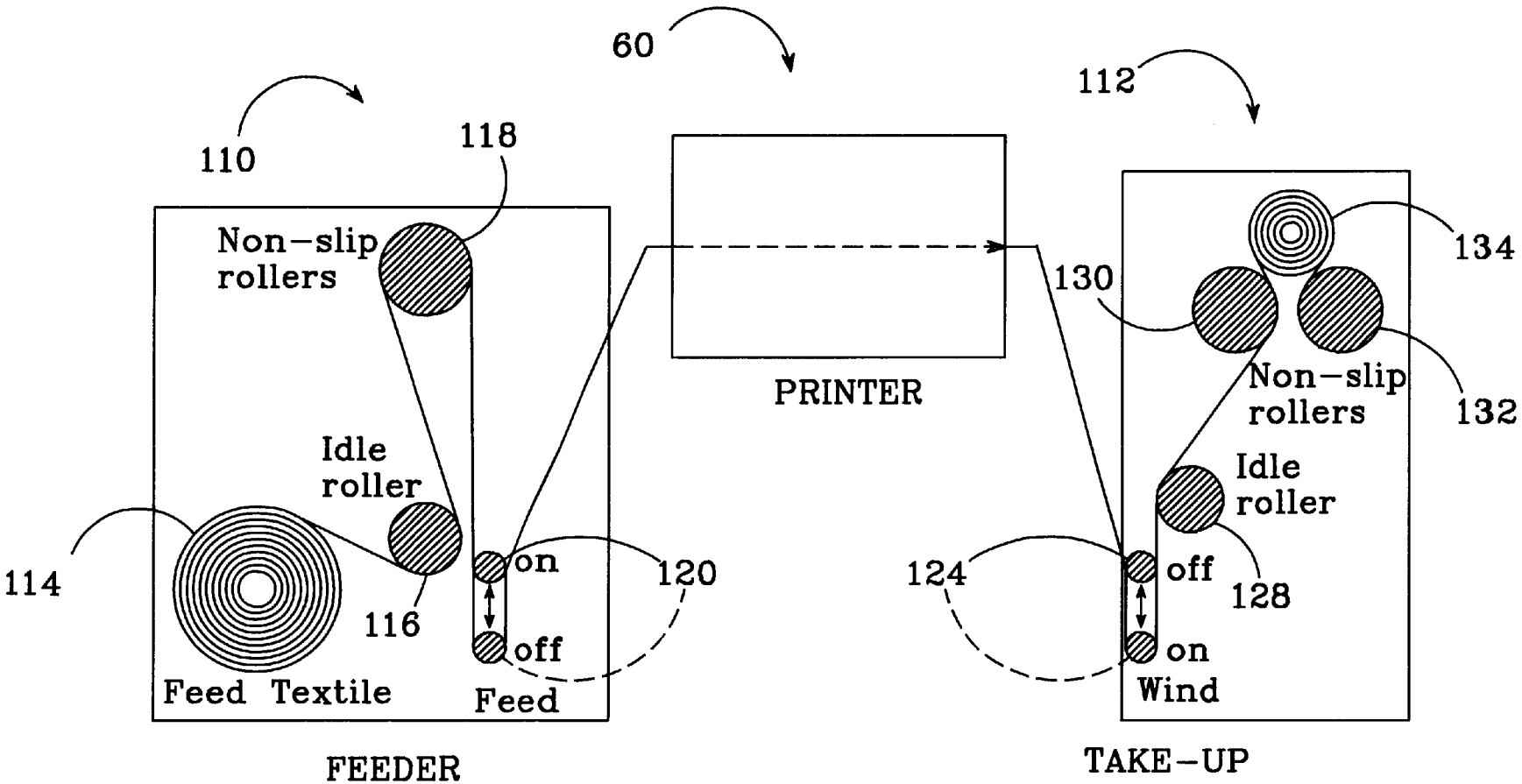
FIG. 5 is a diagram showing the essential components of the feeder and roller assemblies that automatically provide a raw textile to the printer input and automatically roll the printed textile.

FIG. 5 shows the preferred feeder assembly 110 used to automatically feed PFP textiles into the new printer 60 and the take-up assembly 112 used to roll the printed textile from the output of the apparatus 60. Different commercially available feeders and rollers can be used, with the preferred ones being manufactured and provided by Sophis Inc. under the name "Feeder-Winder System".

At the feeder assembly 110 the supply of PFP textile is held on an input roll 114. It is fed past a first idle roller 116, over a non-slip roller 118, and under a first weighted roller 120 that is connected to a first micro-switch (not shown). The first roller 120 moves between the on and off positions of the micro-switch, depending on the tension in the PFP textile, and the feeder 110 stops and starts depending on the state of the micro-switch. If there is tension, the textile pulls the first roller 120 to the first micro-switch on position and if there is little or no tension, the first roller 120 moves to the micro-switch off position. From the first roller 120, the PFP textile feeds into the new printer 60.

At the take-up assembly 112, the printed textile from the new apparatus 60 is fed under a second weighted roller 124 that is connected to a second micro-switch (not shown). The second roller 124 operates similarly to the first roller 120, but when there is tension in the printed textile the second roller 124 moves to the off position and when there is little or no tension it moves to the on position. The printed textile is then fed by a second idle roller 128 and between two non-slip take-up rollers 130 and 132. An output textile roll 134 rests on the two take-up rollers 130 and 132. The rollers 130 and 132 stop and start depending on the state of the second micro-switch. The printed textile rolls onto the output roll 134 when the take-up rollers 130 and 132 turn in unison.

In operation the printer 60 prints at different speeds depending on the type of pattern being printed and it often prints at different speeds while printing the same textile. The feeder and roller assemblies 110, 112 automatically start and stop the feeding and rolling to accommodate the different printer speeds. When the printer 60 begins printing it pulls the supply of PFP textile and causes tension in it. This pulls the first weighted roller 120 to the micro-switch on position, causing the non-slip roller 118 to turn and pull the PFP textile from the input roll 112. This reduces the tension in the supply of PFP textile at the first weighted roller 120 until it moves to the off position.

The roller assembly 112 operates similarly. The take-up rollers 130 and 132 turn to roll the printed textile on the output roll 134. If they turn faster than the printer 60 is printing, they create tension in the printed textile. This pulls the second weighted roller 124 to the second micro-switch off position, causing the take-up rollers 130 and 132 to stop. As the textile printing continues, more of the printed textile exits from the printer 60 until the second weighted roller moves to the on position, causing the take-up rollers 130 and 132 to begin rolling again.

Although the present invention has been described in considerable detail with reference to certain preferred configurations thereof, other versions are possible. As described above, the new printing apparatus 60 can deposit he pre-treat and binder/post-treat solution using many different devices and many different devices can be used to heat the textile to evaporate and cure the deposited solutions. Different peripheral devices can load patterns into the printer and different feeders and rollers can be used. Therefore, the spirit and scope of the appended claims should not be limited to the preferred versions in the specification.

We claim:

1. A method for ink jet printing on a textile, comprising:

depositing a pre-treat solution on said textile;

heating said textile to evaporate excess water from said pre-treat solution;

ink jet printing a pattern on said textile;

heating said textile a second time to evaporate excess water from the ink in said pattern;

depositing a binder/post-treat on said textile; and heating said textile a third time to cure said binder/post-treat.

2. The method of claim 1, wherein said pre-treat solution is an ink catalyst and/or adhesion promoter.

3. The method of claim 1, wherein said pre-treat is an aqueous solution of a cationic suspension of acrylic polymers that contain ammonia or other amine.

4. The method of claim 1, wherein said binder protects said pattern from abrasion, water and UV light.

5. The method of claim 1, wherein said binder forms a protective coating over said pattern and binds to said pre-treat solution after the excess water has been evaporated.

6. The method of claim 1, wherein said binder is an aqueous solution of polyacrylonitrile or latex of polyacrylonitrile.

7. The method of claim 1, wherein said binder is an aqueous solution of silicone polymer or latex of silicone polymer.

8. The method of claim 1, wherein pre-treat and binder are deposited on said textile by one of the methods from the group comprising spraying, rolling, padding and submersion.

9. The method of claim 1, wherein each of said heating steps can be accomplished by one of the devices from the group consisting of heating plate, heated air blower, unheated air blower, IR radiator, microwave radiator, and gas heater.

10. The method of claim 1, comprising the additional step of providing a supply of prepared for printing textile prior to depositing said pre treat solution.

11. The method of claim 1, comprising the additional step of outputting a printed textile after said binder curing step.

12. A device for printing on textiles, comprising:

an ink jet printer for printing an ink pattern on a textile;

a first depositing assembly arranged to deposit a pre-treat solution on said textile before printing;

a first evaporation assembly arranged to evaporate water from said pre-treat solution prior to ink jet printing said ink pattern in said ink jet printer;

a second evaporation assembly arranged to evaporate excess water from said ink pattern after printing by said ink jet printer;

a second depositing assembly arranged to deposit a binder solution on said textile after evaporation of water from said ink pattern; and a third evaporation assembly arranged to evaporate excess water from and cure said binder solution.

13. The device of claim 12, wherein said first, second and third evaporation assemblies are heating assemblies that heat said textile.

14. The device of claim 12, wherein each of said heating elements is one of the devices from the group consisting of a heating plate, heated air blower, unheated air blower, IR radiator, microwave radiator, and gas heater.

15. The device of claim 12, wherein said first and second depositing assemblies are one of the assemblies from the group consisting of a sprayer, roller, padder and submersion tank.

16. The device of claim 12, wherein said pre-treat solution is an ink catalyst and/or adhesion promoter.

17. The device of claim 12, wherein said binder forms a protective coating over said pattern on said textile and binds to said pre-treat solution after the excess water has been evaporated, said binder protecting said ink pattern on said textile from abrasion, water and UV light.

18. The device of claim 12, wherein said binder is an aqueous solution of polyacrylonitrile or latex of polyacrylonitrile.

19. The device of claim 12, wherein said binder is an aqueous solution silicone polymer or latex of silicone polymer.

20. The device of claim 12, further comprising an electronic device, wherein said ink jet pattern is electronically loaded into said printer from said electronic device prior to printing.

21. The device of claim 20, wherein said electronic device is a computer.

22. The device of claim 21, further comprising graphics software within said computer, wherein said ink pattern to be printed by said ink jet printer is generated by said graphics software.

23. The device of claim 21, further comprising a peripheral device in communication with said computer, wherein the pattern to be printed by said ink jet printer is generated at said peripheral device.

24. The device of claim 12, wherein each said heating element is a heating plate, comprising;

a metallic plate;

one or more heater bars on the bottom surface of said metallic plate, the heating of said bars causing said metallic plate to heat;

a power source;

a switch between said power source and said heater bars the closing of said switch causing said heater bars to heat; and a controller to open and close said switch to raise or lower the temperature of said metallic plate.

25. The device of claim 24, further comprising a thermocouple on said metal plate, the output of said thermocouple connected to said controller.

26. The device of claim 12, further comprising an automatic textile feeder to provide a prepared for printing textile prior to depositing said pre-treat.

27. The device of claim 12, further comprising an automatic textile roller to roll the textile after said binder has been cured.

28. A method for ink jet printing a pattern on a textile, comprising the steps of:

depositing a pre-treat solution on a pre-pared for printing textile;

evaporating excess water from said pre-treat solution;

ink jet printing a pattern on said textile;

evaporating excess water from the ink in said pattern;

depositing a binder on said textile; and evaporating excess water from and curing said binder.

29. The method of claim 28, wherein said steps of evaporating excess water from the said pre-treat, ink, and binder are accomplished by heating said textile.

30. The method of claim 28, wherein said binder is cured by heating said textile.

31. The method of claim 28, wherein said pre-treat is an aqueous solution of a cationic suspension of acrylic polymers that serves as an ink catalyst and/or adhesion promoter.

32. The method of claim 28, wherein said binder forms a protective coating over said pattern and binds to said pre-treat solution.

33. The method of claim 28, wherein said binder is an aqueous solution of polyacrylonitrile or latex of polyacrylonitrile.

34. The method of claim 28, wherein said binder is an aqueous solution of silicone polymer or latex of silicone polymer.

35. The method of claim 28, wherein pre-treat and binder are deposited on said textile by one of the methods from the group comprising spraying, rolling, padding and submersion.

36. The method of claim 28, wherein each of said heating steps can be accomplished by one of the devices from the group consisting of heat plate, heated air blower, unheated air blower, IR radiator, microwave radiator, and gas heater.

37. The method of claim 28, comprising the additional steps of providing a raw textile prior to depositing said pre treat solution and outputting a printed textile after said binder curing step.

* * * * *